United States Patent [19]

Ruder, Sr.

[11] Patent Number: 4,606,431

[45] Date of Patent: Aug. 19, 1986

[54] EVACUATION SLIDES FOR MULTI-STORY BUILDINGS

[76] Inventor: Fred A. Ruder, Sr., 39975 Jones Rd., Wellington, Ohio 44090

[21] Appl. No.: 591,200

[22] Filed: Mar. 19, 1984

[51] Int. Cl.[4] ..... A62B 1/20

[52] U.S. Cl. ..... 182/49; 52/182; 193/2 R

[58] Field of Search ..... 182/49, 48; 52/184, 52/185, 182; 193/2; 272/56.5 R

[56] References Cited

U.S. PATENT DOCUMENTS

| | | | |
|---|---|---|---|
| 813,139 | 2/1906 | Brown et al. . | |
| 916,100 | 3/1909 | Brown . | |
| 932,436 | 8/1909 | Brackelsberg . | |
| 937,722 | 10/1909 | Schweimler . | |
| 1,092,662 | 4/1914 | Ottignon . | |
| 1,117,695 | 11/1914 | Novak | 182/48 |
| 1,555,355 | 9/1925 | Charette . | |
| 3,063,513 | 11/1962 | Marryatt | 182/49 |
| 3,088,542 | 5/1963 | Johnson | 182/48 |
| 3,796,429 | 3/1974 | Johnston | 182/49 |
| 4,049,080 | 9/1977 | Suzuki | 182/48 |
| 4,099,596 | 7/1978 | Tracy | 182/48 |
| 4,167,224 | 9/1979 | Kinase | 182/48 |
| 4,482,284 | 11/1984 | Robbins | 182/113 |
| 4,498,557 | 2/1985 | Horne | 182/49 |

FOREIGN PATENT DOCUMENTS

| | | | |
|---|---|---|---|
| 31056 | 9/1910 | Sweden | 182/49 |

*Primary Examiner*—Reinaldo P. Machado
*Attorney, Agent, or Firm*—Renner, Otto, Boisselle & Lyon

[57] ABSTRACT

Escape devices for multi-story buildings characterized by a deployable chute or slide which provides for rapid and easy transfer of building occupants from elevated stories to a lower attitude. An escape device comprises a chute deployable so as to provide an inclined slide surface having an entry end and an exit end, and means for selectively supporting the chute with its entry end positioned at any one of the emergency exits and its lower end at a lower attitude whereby the chute may be positioned as needed to evacuate persons from above ground level stories of the building. Such an escape device may be conveniently stored and only deployed when and where needed. An escape device of different type comprises a substantially flat elongate slide for each flight of steps in a building stairwell and means for mounting the slide in the stairwell for swinging movement from a generally upright position adjacent a side wall of the stairwell to a lowered position overlying in parallel relation the associated flight of stairs. Provision also is made for releasably securing the slide in such upright position to permit usage of the stairwell in conventional manner. Only when the need arises is the slide deployed to provide for rapid transfer of people from landing to landing.

13 Claims, 14 Drawing Figures

EVACUATION SLIDES FOR MULTI-STORY BUILDINGS

DISCLOSURE

This invention relates generally to evacuation or escape devices for multi-story buildings and more particularly to slide-type or chute-type escape devices in various forms usable either inside or outside the building.

BACKGROUND

Over the years major catastrophes involving loss of life have occurred as a result of inadequate means to effect evacuation or escape of occupants from multi-story buildings. The risk of major catastrophe has become even greater with the advent of high rise buildings. In recent high rise hotel fires people have jumped out of windows and many to their death given the imminent alternative of being engulfed by smoke and/or flames.

The stairwells heretofore provided in buildings in an effort to provide for safe evacuation of occupants have many times proven to be inadequate. Walking down multiple flights of stairs even in hurried manner takes considerable time when time is of the essence. In the heat of escape people tend to lose their composure and rush, giving rise to loss of their footing and so on which may result in serious injury or even death and often in further delay. Of course, there additionally remains the serious problem of evacuating invalids, elderly people and others of minimal mobility such as from apartment buildings and hospitals, in which case the steps are of minimal benefit. The only alternative might be to carry such persons down the multiple flights of steps which inordinately occupies a rescuer's time minimizing the amount of service that he can provide during evacuation. This of course assumes that the rescuer can even reach the occupants requiring assistance.

In addition to stairwells, other types of fire escapes have been devised over the years. In U.S. Pat. No. 1,092,662 there is disclosed a fire escape consisting of an arrangement of chutes situated between each floor of a building in an area divided off from the main part of the building by means of fireproof walls. The fire escape is particularly adapted to be installed in the building when the same is erected presumably as an alternative or in addition to conventional stairwells. In the former case, the building is denied the utility which stairwells provide as an alternate means of passing between floors independently of elevators under normal conditions. In the latter case, the provision of the auxiliary fire escape arrangement would add to the cost of the building while reducing available space for other uses.

Other types of escape devices employing slides or chutes have been employed outside of the building. Typically, these devices are fixed to the side wall of the building for usage only in conjunction with a limited number of emergency exits. Usually the fire escape has associated therewith only one emergency exit per story of the building. Obviously this presents a problem when access to the emergency exit is denied by smoke, flame, etc. Consequently, those people denied access to the emergency exits might then be left with less desirable escape means such as jumping out of windows onto mats or nets or awaiting rescue by fire ladders if the ladder has sufficient length to reach them.

For an example of one escape device for a multi-story building employing a meandering chute, reference may be had to U.S. Pat. No. 4,049,080. The meandering chute extends the full height of the building there being provided an emergency exit in the outer side wall of each story of the building. Although this arrangement might have some practical application in relatively low rise buildings, it is not considered feasible for many of the high rise buildings being constructed today. Obviously considerable cost is involved to provide such a chute extending the full height of a building having thirty, forty or more stories. Such arrangement also would detract from the aesthetics of the building. Moreover, such device does not adequately address the problem where occupants cannot gain access for one reason or another to the emergency exit for the story they are on.

Other chute-type or slide-type fire escapes which have been devised for buildings having relatively few stories can be seen in U.S. Patent Nos. 813,139; 916,100; 932,436; 937,722; 1,555,355; 4,099,596; and 4,167,224. Some of these fire escapes are retractable when not in use while others employ spiral slides or chutes.

SUMMARY OF THE INVENTION

The present invention provides novel and advantageous fire escape devices for multi-story buildings which overcome one or more of the drawbacks associated with known escape devices or schemes. Each of the devices herein is characterized by a deployable chute or slide which provides for rapid and easy transfer of building occupants from elevated stories to a lower attitude.

According to one aspect of the invention, a portable or relocatable escape device is usable with a multi-story building wherein the windows thereof constitute a plurality of emergency exits for respective stories of the building. The escape device comprises a chute deployable so as to provide an inclined slide surface having an entry end and an exit end. The device also comprises means for selectively supporting the chute with its entry end positioned at any one of the emergency exits and its lower end at a lower attitude whereby the chute may be positioned as needed to evacuate persons from above ground level stories of the building.

In one form of portable escape device, the support means provides for detachable securement of the chute to the building at any one of a plurality of locations which provide for positioning of the entry and exit ends of the cute at respective windows or emergency exits of the building. Preferably such detachable securement is obtained by hook devices on the chute or other attachment devices at one or both ends of the chute cooperable with mating attachment devices fixed to the building adjacent each window or emergency exit. There alternatively or additionally may be provided a hoist mechanism preferably mounted on tracks atop the building for lowering and positioning the chute when and where needed.

In another form of relocatable escape device, the chute consists of a plurality of telescoping sections extendable from a compact easily transported form to provide a continuous slide surface over the collective length of the extended sections. The support means in this form preferably consists of a transport vehicle for the extendable chute.

As will be appreciated, escape devices according to this aspect of the invention do not have their usefulness limited to a single emergency exit for each story of the building nor must an escape device be installed in relation to each story at all times which usually detracts from the aesthetic appearance of the building. Rather, one or more escape devices may be conveniently stored and only deployed when and where needed.

According to another aspect of the invention, an escape device for a multi-story building having an interior stairwell including multiple flights of steps between associated landings comprises a substantially flat elongate slide for each flight of steps. The device further comprises means for mounting the slide in the stairwell for swinging movement from a generally upright position adjacent a side wall of the stairwell to a lowered position overlying in parallel relation the associated flight of stairs. Provision also is made for releasably securing the slide in such upright position to permit usage of the stairwell in conventional manner. Only when the need arises is the slide deployed to provide for rapid transfer of people from landing to landing.

According to still another aspect of the invention, there is provided another form of escape device in combination with a multi-story building having a horizontal row of emergency exits in the outer side wall of at least one upper story of the building and a horizontal rail or the like parallel and adjacent to such horizontal row of emergency exits. The escape device permitting rapid transfer of people from such upper story of the building to ground level comprises an inclined chute, an upper support supporting the upper end of said chute on the horizontal rail for travel therealong, and a lower support for suppoting the lower end of the chute at ground level for travel therealong parallel to the horizontal rail. Such device is particularly useful with relatively low rise buildings such as motels to provide for evacuation of persons from the second or third story of such buildings.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
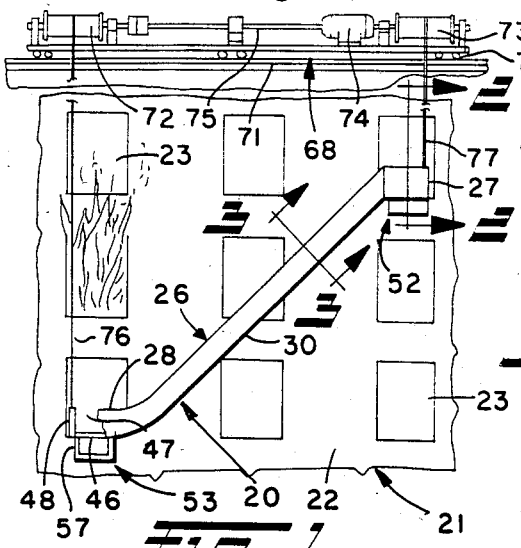
FIG. 1 is a fragmentary schematic elevational view of a building with a portable escape device deployed thereon in accordance with the invention.

In the drawings, FIGS. 1-4, FIG. 5 and FIG. 6 respectively show three preferred forms of portable or relocatable escape devices according to the present invention. Each escape device has application with multi-story buildings wherein the windows thereof constitute a plurality of emergency exits for respective stories of the building. Each illustrated escape device is characterized by a chute deployable so as to provide an inclined slide surface having an entry end and an exit end. Each device also comprises means for selectively supporting the chute with its entry end positioned at any one of the emergency exits and its lower end at a lower attitude whereby the chute may be positioned when and where needed to evacuate persons from above ground level stories of the building.

In FIG. 1, a portable escape device is designated generally by reference numeral 20. The escape device 20 is shown as it would be deployed outside of a multistory building 21 having at its outer side wall 22 window openings 23 which additionally serve as plural emergency exits for respective stories of the building. Preferably the windows of such openings 23 can either be opened or removed to permit emergency passage of a person through the window opening. As is typical of conventional building designs, the window openings are arranged in vertical and horizontal rows with the window openings in any one row being equally spaced apart. Consequently the diagonal spacing between adjacent horizontally offset window openings for adjacent stories of the building remains constant over the particular face of the building. The illustrated portions of three adjacent stories of the building may correspond to any three stories of the building which may be of low, medium or high rise type.

Although the portable escape device 20 is shown and will be described in relation to its deployed condition, it should be understood that the device normally will be stored elsewhere and deployed only when and where needed. For example, one or more of such devices might be conveniently stored on the roof of the building or other location accessible to provide for rapid deployment of the device.

The escape device 20 comprises a chute 26 having generally parallel entry and exit portions 27 and 28 and an intermediate inclined slide portion 30 extending between the entry and exit portions. For reasons that will become more apparent below, the entry and exit portions 27 and 28 are vertically offset an integer multiple of the center to center spacing of window openings 23 in the vertical rows and horizontally offset an integer multiple of the center to center spacing of window openings in the horizontal rows. Consequently the escape device may be deployed as illustrated with the entry and exit portions located outwardly adjacent respective window openings for different stories of the building and with the slide portion 30 extending downwardly at an incline from the upper one to the lower one of such window openings.

Figure 3:
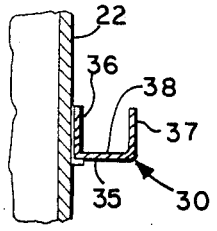
FIG. 3 is another enlarged fragmentary section through the building side wall and the device of FIG. 1 taken substantially along the line 3—3 thereof.

As seen in FIG. 3, the slide portion 30 has a bottom wall 35 and parallel inner and outer side walls 36 and 37 extending upwardly from opposite longitudinal edges of the bottom wall. The top surface 38 of the bottom wall 35 is relatively smooth and constitutes an inclined slide surface when the escape device is deployed as shown in FIG. 1. The interior surfaces of the side walls 36 and 37 also desirably are smooth and free of obstructions that might hinder or cause injury to persons sliding down the chute on the slide surface 38. As will be appreciated, the inner and outer side walls serve to contain a person within the chute as he or she slides therealong. Although the illustrated intermediate portion is generally U-shape in transverse cross-section, such may be otherwise configured with sufficient concavity being provided at the slide surface 38 to prevent persons from accidentally falling out of the chute.

Figure 2:
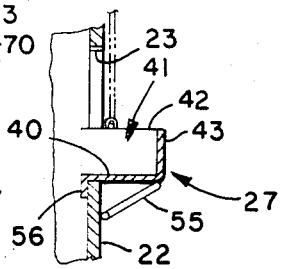
FIG. 2 is an enlarged fragmentary section through the side wall of the building and the device of FIG. 1 taken along the line 2—2 thereof.

As best seen in FIG. 2, the entry portion 27 of the chute 26 has a horizontal, rectangular platform 40 joined at one edge to the top edge of the bottom wall 35 of the slide portion 30. Above the platform, an entrance area 41 is closed at two sides by upright walls 42 and 43 joined to respective edges of the platform 40. The other two sides of the entrance area 41 respectively open to the top of the slide portion 30 and to the interior of the building 21 at the inwardly adjacent window opening 23.

At the exit portion 28 of the chute 26, the bottom wall 35 of the slide portion 30 gradually curves to the horizontal to form a level platform 46 at its lower end. The outer side wall 37 of the slide portion also may gradually curve in a vertical plane to close off the outer side of an exit area 47 above the platform 46. Also provided is an upright end wall 48 at the terminal end of the bottom wall 35 which closes off the lower end of the chute for obvious reasons. Like the entrance area 41, the exit area 47 opens to the interior of the building at the inwardly adjacent window opening 23.

The escape device 20 further comprises supports for holding the chute 26 to the side of the building after the chute has been selectively positioned with its entry and exit portions adjacent respective window openings 23. In the illustrated embodiment, supports indicated generally at 52 and 53 are respectively provided at the entry and exit portions 27 and 28 of the chute.

As seen in FIG. 2, the upper support 52 includes a bracket rest 55 and a catch member 56 forming a hook with an inwardly projecting portion of the platform 40. As shown, the platform 40 extends sufficiently inwardly for resting engagement atop the bottom edge of the window opening 23. The catch member 56 extends downwardly from the inner edge of the platform 40 and is adapted to engage or grip the interior surface of the building side wall 22 adjacent the window opening 23. The bracket rest 55 on the other hand is secured to the outer edge of the platform 40 and slopes inwardly for engagement with the outer surface of the building side wall 22 sufficiently beneath the window opening 23 to hold the upper end of the chute stable. The lower support 53 is essentially identical to the upper support 52, the bracket rest therefor being seen at 57.

With the foregoing supports 52 and 53, the escape device 20 may be positioned at the side of the building 21 with its entry and exit portions 27 and 28 located outwardly adjacent respective window openings 23. The inner margins of the entry and exit portions then may be allowed to pass into the window openings and then the escape device further lowered to effect holding engagement with the building side wall 22 bordering the bottom edge of the window opening 23. It should be noted that the illustrated supports are exemplary. Other supports, attachment devices, etc. may be employed which provide for ready mounting and demounting of the escape device such as by lowering and lifting, respectively.

Figure 4:
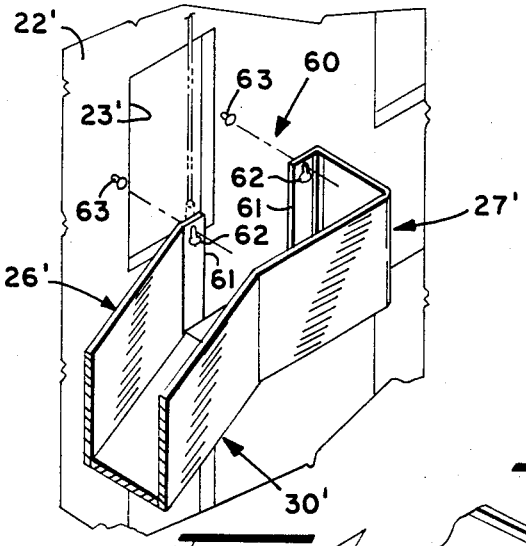
FIG. 4 is a fragmentary perspective view illustrating alternative means of detachably securing an escape device to the side of a building.

In FIG. 4, one such alternative support arrangement is indicated generally at 60. As shown, the entry portion 27′ of the chute 26′ may be provided with parallel flange plates or hangers 61, each having a keyhole slot 62 adapted to mate with respective locking pins 63 secured to the building side wall 22′ at opposite sides of the window opening 23′. A similar arrangement also may be provided at the exit portion of the chute 26′.

The escape device 20 may be selectively positioned where needed by any suitable means. One contemplated approach is to utilize a helicopter with a winch for lowering and positioning the escape device at the side face of the building. In FIG. 1, another alternative approach can be seen to involve the usage of a hoist 68 mounted for movement on a rail or rails at the top of the building. The hoist 68 includes a carriage 69 mounted by rollers 70 on the rail 71 extending along the top edge of the building. Mounted on the carriage are cable drums 72 and 73 which are rotatably driven by means of a drive motor 74 through the shaft transmission 75. Wrapped around the drums 72 and 73 are respective cables 76 and 77 which are detachably connected at their lower ends by suitable brackets to the entry and exit portions of the chute 26. As will be appreciated, the escape device 20 may be raised and lowered in a manner quite similar to a window washers scaffold, with horizontal positioning being effected by movement of the carriage along the rails. If the escape device always remains connected to the hoist during evacuation, it will be appreciated that the supports 52 and 53 would then be superfluous and could be eliminated with full support for the escape device being provided by the hoist. Of course, the hoist may be utilized to selectively position a number of escape devices where needed on the particular side face of the building.

The escape device 20 of FIG. 1 has particular usage with those buildings designed to contain a fire at least for a time to the story of its origin. In buildings of this design, a standard operating procedure in the event of a fire is for those persons on stories beneath the fire floor to make way to ground level via the building's interior stairwells. On the other hand, those persons on stories above the fire floor are to travel to the roof of the building via the interior stairwells where they might possibly be transported away from the building by helicopter.

There is however the possibility that smoke from the fire might enter the stairwells and fill the same above the fire floor thus precluding usage of the stairwells by persons on stories above the fire floor. Also those persons on the story or stories immediately above the fire floor would be in greatest jeopardy since the fire is more likely to spread upwardly rather than downwardly. If these were some means by which the persons on the floor above the fire floor could get to the floor beneath the fire floor independently of the smoke-filled interior stairwells, then the positions of such persons would be improved. The escape device 20 provides such a means independently of any permanent fixture provided on the outside of the building.

As seen in FIG. 1, the entry and exit portions 27 and 28 of the chute 26 are vertically offset by about the combined height of two stories of the building 21. Accordingly, the entry and exit portions of the chute may be located outwardly adjacent the window openings or emergency exits 23 respectively on the stories immediately above and below an intermediate story where the fire is located as illustrated. Only thusly positioned, persons on the story above the fire floor may exit through the window opening and onto the entry portion 27 of the chute 26, then slide down the chute to the exit portion 28 thereof and thereafter re-enter the building on the story beneath the story involved with fire.

Although the illustrated escape device 20 spans only a single intermediate story of the building, it will be appreciated that the chute may be lengthened in diagonal dimension to span more than one intermediate story such as two or three stories. As a result, persons on the story immediately above the fire floor may be discharged to a story one or more stories beneath the story involved with fire. On the other hand, those persons on floors several stories above the fire floor also may be evacuated to a story beneath the fire floor by the escape device.

Figure 5:
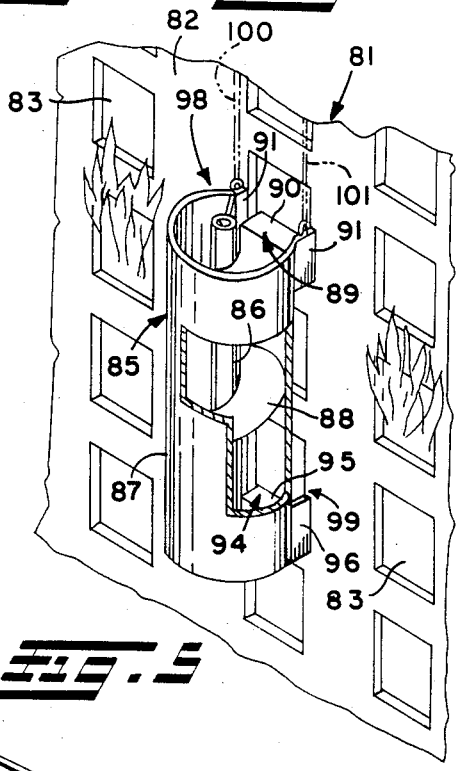
FIG. 5 is a fragmentary schematic perspective view, partly broken away and in section, showing another form of relocatable escape device according to the invention.

Referring now to FIG. 5, another form of relocatable escape device according to the invention is designated generally by reference numeral 80. The escape device 80 is shown as it would be deployed outside a multistory building 81 having at its outer side wall 82 window openings 83 which additionally serve as plural emergency exits for respective stories of the building. In pertinent respect, the window openings 83 are arranged in vertical rows with the windows therein being equally spaced apart.

The escape device 80 comprises spiral chute 85 including an inner cylinder 86, a concentric outer cylinder 87 of greater diameter and a spiral slide 88 connected between the inner and outer cylinders. At its top end, the outer cylinder 87 has a side opening 89. A horizontal platform plate 90 projects from the bottom edge of the side opening 89 and vertical side plates 91 from respective vertical edges of the side opening.

The platform plate 90 projects beyond a line tangent to the outer cylinder 87 whereby it may be positioned to extend through a window opening 83 in supporting relation atop the lower edge of the window opening. On the other hand, the side plates 91 terminate at a plane tangential to the outer cylinder and desirably are spaced apart sufficiently to engage the outer surface of the building side wall 82 at respective sides of the window opening. Although not shown, the platform plate may be provided at its distal end with a downwardly extending catch member adapted to engage or grip the interior surface of the building side wall 82 adjacent the window opening 83 in a manner similar to that discussed above in connection with the embodiment of FIGS. 1–3. At its lower end, the outer cylinder 87 similarly is provided with a side opening 94, horizontal platform plate 95 and side plates 96. It further is noted that the platform plates 90 and 95 respectively coincide with the top and bottom of the spiral slide 88.

It thus can be seen that the side openings 89 and 94 and associated platform and side plates respectively define entry and exit portions of the spiral chute 85. For reasons that will become more apparent below, such entry and exit portions, generally designated by reference numerals 98 and 99, are vertically offset an integer multiple of the center to center spacing of the window openings 83 in the vertical rows thereof. Consequently the escape device may be deployed as illustrated with the entry and exit portions located at respective window openings for different stories of the building. In the illustrated embodiment, the vertical spacing is such that the entry and exit portions may be positioned at window openings for stories located above and below one intermediate floor.

The escape device 80 may be selectively positioned where needed by any suitable means such as those discussed above in connection with the FIGS. 1–3 embodiment. For example, a hoist similar to that seen in FIG. 1 may be employed to position the escape device, the cables of such hoist being seen in phantom lines at 100 and 101 in FIG. 5. The overall usage of the escape device 80 is generally similar to that discussed above in connection with FIGS. 1–3 except that persons exiting one story of a building at a window opening therein will re-enter the building at a lower story at a window opening vertically below that of the upper story rather than one which is horizontally staggered as well in the case of the FIGS. 1–3 embodiment.

Figure 6:
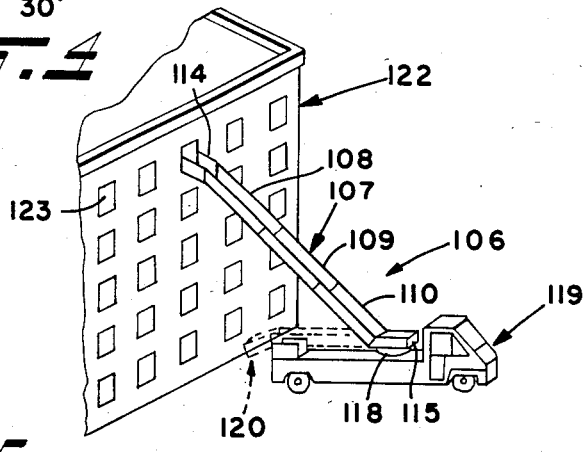
FIG. 6 is a fragmentary schematic perspective view illustrating still another form of portable escape device according to the invention.

In FIG. 6, still another form of relocatable escape device according to the invention is designated generally by reference numeral 106. The escape device comprises a chute 107 including a plurality of telescoping sections 108–110 which are extendable from a compact, easily transported form to provide a continuous slide surface over the collective length of the extended sections. Although three sections are illustrated, two or more may be provided as desired.

At the top of the chute 107, there preferably is provided an entry section 114. The entry section 114 preferably is pivotally or hingedly connected to the distal end of the outermost section 108 such that it can be tilted as needed in relation to the chute 107 for desired orientation in relation to an emergency exit of a building. The lower end of the chute 107 is hingedly or pivotally connected to a receiving platform 115, such pivotal or hinged mounting providing for desired positioning of the chute in relation to a building.

As shown, the receiving platform 115 may be mounted for rotation about a vertical axis by a turntable 118 on the bed of a transport vehicle 119. When not in use, the chute may be contracted and stored horizontal on the bed of the truck as seen in phantom lines at 120.

In the event of a fire in a building such as that seen at 122, the transport vehicle 119 may be dispatched from its garaged location to the fire location and parked adjacent the building. The chute 107 may then be deployed in a manner similar to that of a conventional fire ladder. That is, the chute 107 is pivotally raised and rotated and the chute extended to locate the entry section 114 at a window opening or emergency exit 123. Persons may then exit through the window opening 123 and slide down the chute and onto the receiving platform 115 from which they can exit onto the ground. As will be appreciated, the chute 107 can be repositioned to effect escape of persons from any number of the emergency exits at the various above ground stories of the building.

Turning now to FIGS. 7–11, an escape device according to another aspect of the invention is designated generally by reference numeral 130. The escape device 130 is intended for employment in an interior stairwell 131 including multiple flights 132 of steps 133 between associated landings 134 and 135. As will be appreciated, the escape device 130 may be provided for each flight of steps to provide for rapid transfer of persons between the upper and lower landings associated with each flight of steps.

Figure 8:
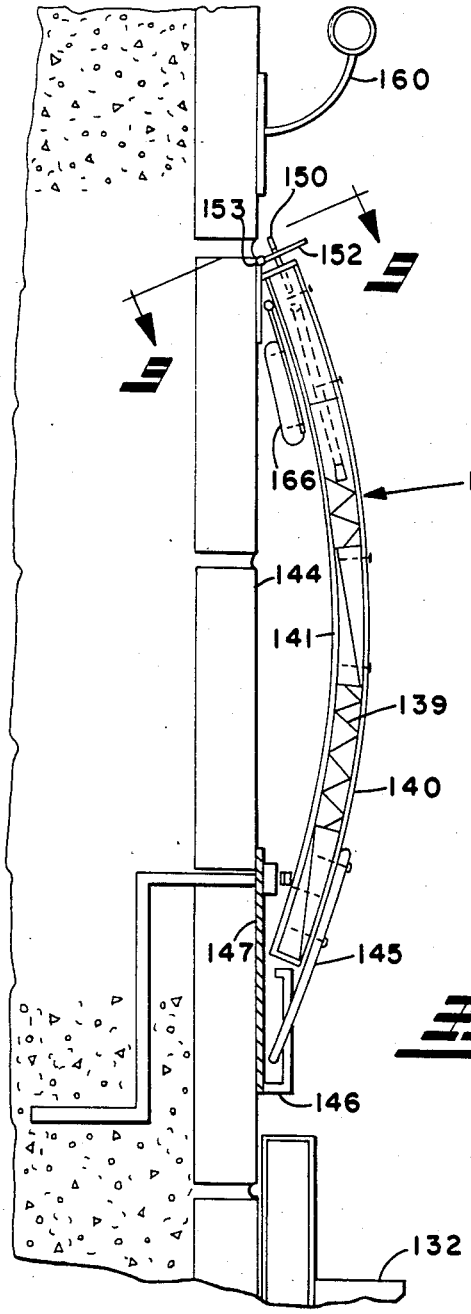
FIG. 8 is a fragmentary enlarged section through the stairwell and device of FIG. 7 taken along the line 8—8 thereof.
Figure 9:
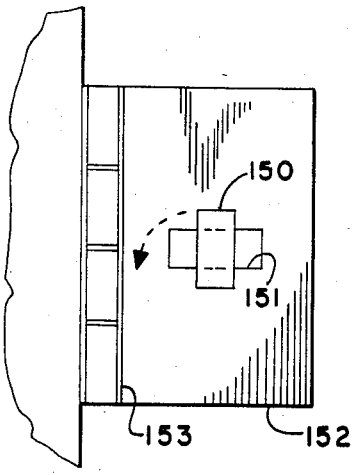
FIG. 9 is an enlarged view showing a quick release mechanism employed in the device of FIG. 8 as seen from the line 9—9 thereof.

The escape device 130 comprises a substantially flat, elongate slide 138. As best seen in FIG. 8, the slide 138 may be fabricated from a slightly bowed corrugated core 139 surrounded by a smooth skin 140 made of plastic, for example. The slide accordingly has a concave slide surface 141 extending along its length.

Figure 7:
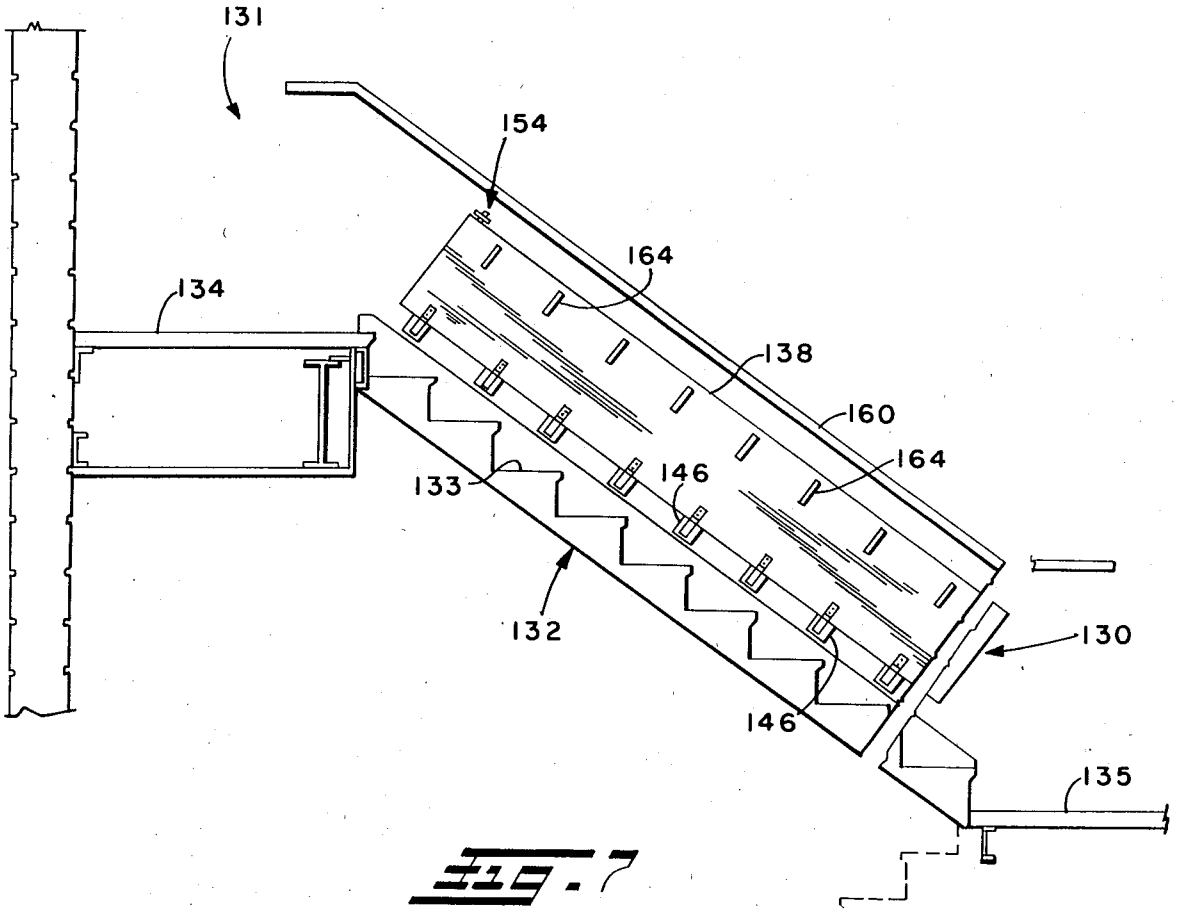
FIG. 7 is a fragmentary vertical section through a stairwell in a building showing another form of deployable escape device according to the invention.

The slide 138 may be mounted by any suitable means for swinging movement from a generally upright position adjacent the side wall 144 of the stairwell to a lowered position overlying the associated flight 132 of steps. In the illustrated embodiment, the slide has secured along one edge thereof in longitudinally spaced relation a plurality of loop members 145 adapted to be engaged in the bites of respective hook brackets 146 secured to the stairwell side wall 144 by mounting plates 147 which may be suitable anchored in the building structure as shown. As seen in FIG. 7, the hook brackets 146 are arranged along a line extending parallel to the flight 132 of stairs.

Provision also is made for releasably securing the slide 138 in an upright position as seen in FIGS. 7 and 8. At its side edge opposite the loop members 145, the slide has rotatably mounted thereto a key 150 adapted to fit into a keyhole slot 151 (FIG. 9) provided in a key plate 152 hingedly secured at 153 to the stairwell side wall 144 as shown. To secure the slide in its upright position, the key plate 152 may be swung down over the key 150 and then the key rotated to lock the slide in such position. Preferably the quick release lock mechanism, generally indicated at 154 in FIG. 7, is located at the upper end of the slide 138 whereby such mechanism can be manipulated by a person on the landing 134 adjacent the upper end of the slide.

As seen in FIGS. 7 and 8, the slide 138 preferably has a width permitting its storage in upright position beneath a handrail 160 typically provided in the stairwell. Moreover, the transverse bow of the slide preferably is not such that it projects away from the stairwell side wall 144 much beyond the handrail. Accordingly, the slide in its upright position presents minimal obstruction to usage of the stairwell under normal conditions.

Figure 11:
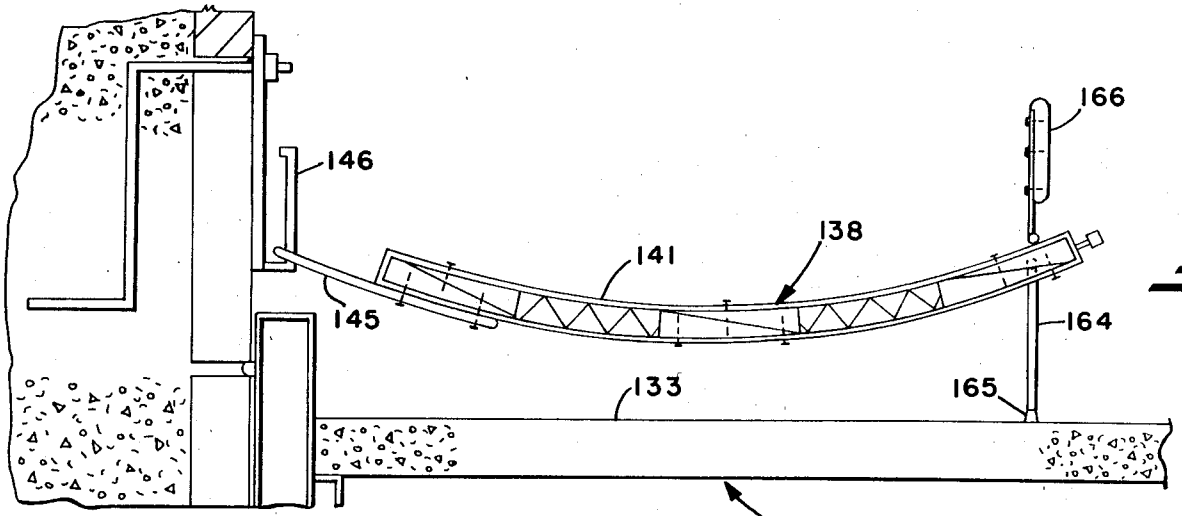
FIG. 11 is a section similar to that of FIG. 8 but with the escape device shown in its deployed condition.
Figure 10:
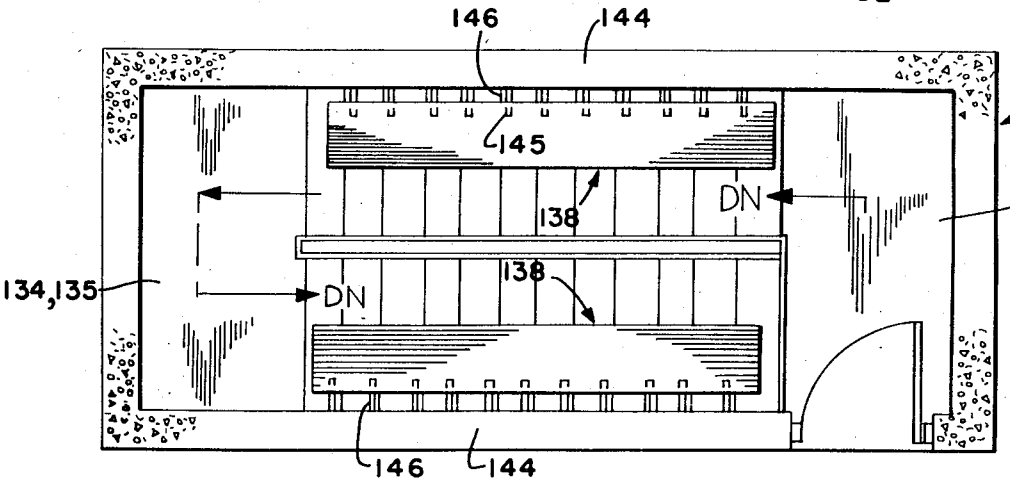
FIG. 10 is a reduced horizontal section through the stairwell showing two of the escape devices in their deployed conditions.

When needed, the slide 138 may be deployed to provide for rapid transfer of people from the upper landing 134 to the lower landing 135 adjacent opposite ends thereof. To effect such deployment, the key 150 simply is rotated, the key plate 152 lifted and then the slide lowered to its operative position overlying the associated flight 132 of stairs as seen in FIGS. 10 and 11. When in its lowered position, the slide is supported substantially parallel to the flight of stairs.

Although the slide 138 may simply be supported atop the flight 132 of stairs, the slide of the illustrated embodiment is supported slightly above the flight of stairs at one edge by the loop member/hook bracket hinge supports and at its other edge by a plurality of legs 164 pivotally secured to the slide along its longitudinal edge opposite its point of hinged securement to the stairwell wall. Such legs 164 are secured to the slide at longitudinally spaced locations and desirably are self-deploying when the slide is lowered. That is, the legs may be pivotally mounted at their top ends to the slide for free swinging movement from their retracted phantom line position seen in FIG. 8 to their deployed position seen in FIG. 11. When deployed, each leg has a foot 165 operative to engage a respective step 133 of the stairs 132. It will be appreciated that the slide need not necessarily have high strength along its longitudinal extent inasmuch as the slide is supported at its longitudinal edges at a plurality of locations. As seen in FIGS. 8 and 11, the escape device 130 also may include a side rail 166 pivotally secured to the slide adjacent its longitudinal edge opposite its hinge supported edge. When the slide is in its stored upright position, the side rail 166 may be pivoted substantially flush to the slide surface 141 thereby to permit securement of the slide in its upright position as seen in FIG. 8. When the slide is deployed as seen in FIG. 11, the side rail may be raised to a vertical stop position to facilitate containment of persons on the slide surface 141 as they slide down the slide.

With an escape device 130 provided in a building stairwell for each flight of steps, it will be appreciated that rapid and easy transfer of building occupants from upper floors to lower floors can be effected. When the devices are deployed, a person can slide therealong for more rapid passage between adjacent landings in a much speedier manner than if they had to walk or even run down the steps. Also, invalids, elderly people or others not capable of walking down the steps may be assisted as needed by individuals positioned at each landing who may help the person onto and off the slides until they reach ground level or other safe story of the building. Accordingly, a relatively large number of such persons having minimal mobility can be rapidly evacuated from the building.

Figure 12:
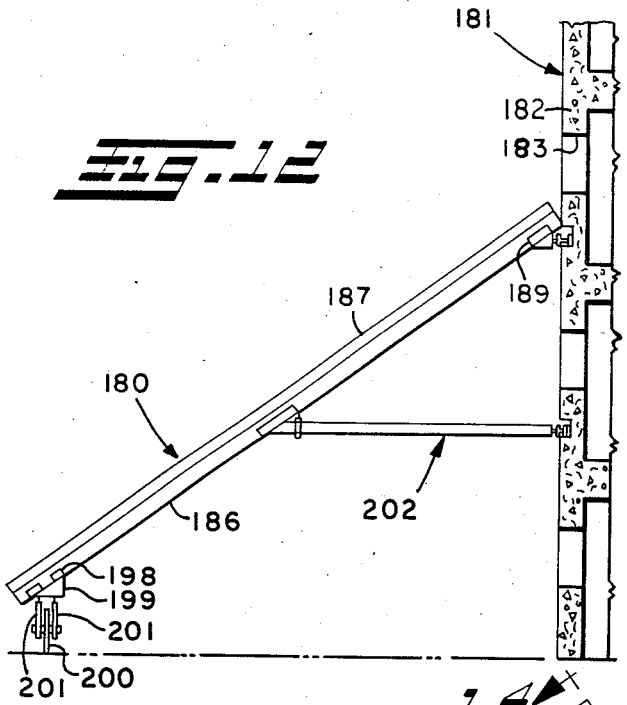
FIG. 12 is a side elevational view of yet another form of escape device according to the invention.
Figure 13:
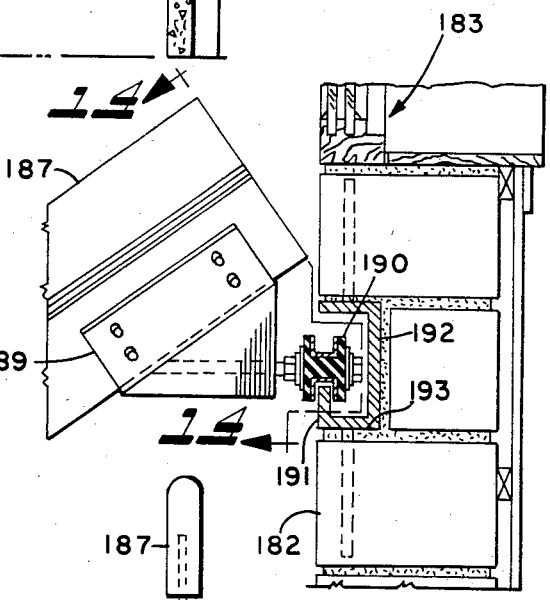
FIG. 13 is an enlarged fragmentary portion of FIG. 12.
Figure 14:
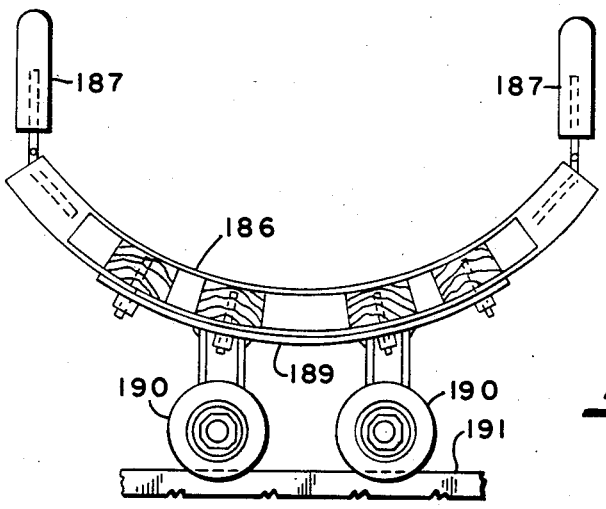
FIG. 14 is an end elevational view of the escape device as seen from the line 14—14 of FIG. 13.

Referring now to FIGS. 12–14, still another form of relocatable portable escape device is designated generally by reference numeral 180. The escape device 180 is particularly useful with low-rise buildings having, for example, two or three stories, such as motels. A representative building is designated generally by reference numeral 181 which can be seen to have at its outer side wall 182 a horizontal row of window openings 183 associated with at least one upper story of the building. As will be appreciated, the window openings 183 may additionally serve as plural emergency exits for such upper story of the building, such window openings being associated with respective rooms and/or hallways of the building. Preferably the windows in such openings can either be opened or removed to permit emergency passage of a person through the window opening.

The escape device 180 comprises a chute 186 supported top and bottom at an incline to the horizontal. The chute by way of preferred example can be in the form of a reinforced fiberglass slide having an upwardly concave or bowed transverse cross section. Along each edge of the slide there are provided hinged handles 187 which are shown in their upright position. The handles cooperate with the bowed slide to prevent a person from falling off the slide as he slides therealong.

The chute 186 at its upper end is fixed in a metal saddle 189 to which a pair of transversely spaced rollers 190 are mounted for rotation about respective horizontal axes. Each roller is of grooved type and supported on a horizontal rail 191 for rolling traverse along such rail. As best seen in FIG. 13, the rail 191 may be formed by the upright lower leg of a generally C-shape metal angle grouted or otherwise fixed in the side wall 182 of the building as in a reglet 193.

The rail 191 extends parallel to the horizontal row of window openings 183 and is located below such window openings such that the upper end of the chute is disposed generally at the base of a window opening when aligned therewith. As seen in FIG. 13, the grooved roller may have a metal wear insert in the groove thereof to extend the life of the roller as well as to facilitate relatively free rolling movement of the roller along the rail.

At its lower end, the chute 186 is fixed by metal saddles 198 to a bracket assembly 199. The bracket assembly 199 has mounted therebeneath a wheel 200 adapted to roll on the ground. Preferably, the wheel is mounted to the bracket assembly by a pair of spring/shock absorber assemblies 201. The wheel also may be in the form of an inflatable rubber tire. As illustrated, the wheel is mounted for rotation about a horizontal axis extending at right angles to the outer side wall of the building whereby the chute can be pushed or otherwise caused to traverse the outer side wall of the building for selective alignment with any one of the window openings. As also seen in FIG. 12, there may be provided, if needed, an intermediate support 202 for the chute such as in the manner illustrated.

The escape device 20, rollingly supported at its upper and lower ends, may be moved transversely along the outer side wall of the building 182 for selective positioning where needed at any one of the window openings 183. When thusly positioned, occupants of the building having access to the window opening may exit therethrough and slide down the chute onto the ground. As needed, the chute can be repositioned to effect escape of persons through other ones of the emergency exits.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. In a multi-story building having an interior stairwell including multiple flights of steps between associated landings, the improvement comprising an escape device including a substantially flat elongate slide, and means for mounting said slide in said stairwell for swinging movement from a generally upright storage position adjacent a side wall of said stairwell to a lowered position overlying one of said flights of steps.

2. The building of claim 1, further comprising means for releasably securing said slide in such upright position.

3. The building of claim 2, wherein said slide is slightly convex in transverse section.

4. The building of claim 2, wherein said means for mounting includes means for pivotally supporting said slide at one side thereof.

5. The building of claim 4, including means engageable with the flight of steps to support said slide at its other side when in such lowered position.

6. The building of claim 5, wherein said means to support includes at least one leg pivotally secured to said slide at such other side.

7. The building of claim 5, including a side rail mounted to said slide at such other side for pivotal movement from a position substantially flush with the slide surface of said slide to a position extending substantially at right angle to such slide surface.

8. The building of claim 2, said slide having a length substantially equal to the length of said one of said flights of steps.

9. The building of claim 2, wherein said means for releasably securing includes a quick release lock mechanism.

10. The building of claim 9, wherein said quick release lock mechanism includes key and keyhole slot means at the upper end of said slide.

11. The building of claim 1, including plural said slides at respective said flights of steps and respective means for mounting said slides in said stairwell for swinging movement from a generally upright position adjacent respective side walls of said stairwell to a lowered position overlying respective said flights of steps.

12. The building of claim 1, including a handrail secured to said side wall of said stairwell at a height above said one of said flights of steps, and wherein said slide in such generally upright position has a height less than such height of said handrail.

13. The building of claim 1, wherein said means for mounting includes loop members secured along one side of said slide and hooks secured to said side wall to receive therein said loop members.

* * * * *